United States Patent [19]

Yamashita

[11] 4,354,627

[45] Oct. 19, 1982

[54] DEVICE FOR HIGH SPEED FEEDING OF A TAPE OR THE LIKE

[76] Inventor: Kyoichi Yamashita, 2361 Nippa-cho, Kohoku-ku, Yokohama-shi, Kanagawa 223, Japan

[21] Appl. No.: 203,876

[22] Filed: Nov. 4, 1980

[30] Foreign Application Priority Data

Nov. 9, 1979 [JP] Japan ..... 54-144312

[51] Int. Cl.[3] ..... B65H 17/22

[52] U.S. Cl. ..... 226/188; 226/120

[58] Field of Search ..... 226/65, 95, 120, 134–136, 226/188–190, 157; 242/206–210; 227/112

[56] References Cited

U.S. PATENT DOCUMENTS

| | | | |
|---|---|---|---|
| 3,412,620 | 11/1968 | Bloom et al. | 74/141 |
| 3,652,001 | 3/1972 | Artelt, Jr. | 226/65 |
| 3,926,355 | 12/1975 | Bonnell | 226/145 X |
| 4,125,074 | 11/1978 | Sato | 101/288 |
| 4,300,712 | 11/1981 | Takeuchi | 226/157 |

*Primary Examiner*—Leonard D. Christian

*Attorney, Agent, or Firm*—Armstrong, Nikaido, Marmelstein & Kubovcik

[57] ABSTRACT

In a device for high speed feeding and stopping of an article which comprises a shaft, a drum fitted for carrying said article fitted to said shaft, a first clutch having an external cylinder and being mounted on said shaft, a high speed crank for driving said drum at a high speed linked to said shaft with said first clutch, a second clutch on said shaft, and a low speed crank for driving said drum at a low-speed linked to said shaft with said second clutch, the improvement which comprises a brake disk integral with said shaft, a steel ball containing cylinder integral with the external cylinder of said first clutch for high speed driving, a plurality of steel balls arranged between said brake disk and said steel ball containing cylinder, and a plurality of projections positioned closely to said steel balls interposable between said brake disk and said steel balls, whereby said steel balls are detached from said brake disk during the backward stroke period of the external cylinder of said first clutch for high speed driving.

3 Claims, 10 Drawing Figures

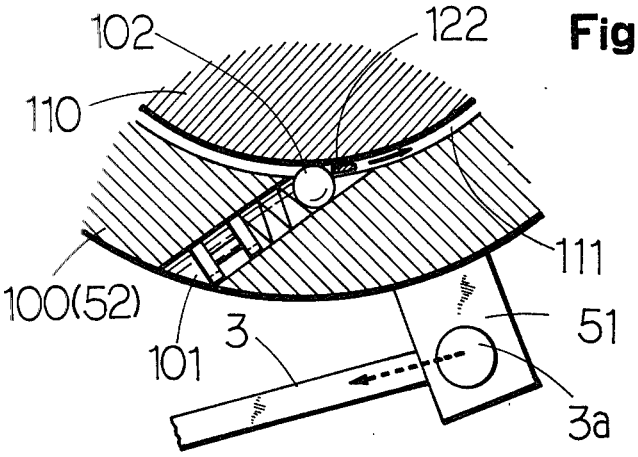
Fig 5d
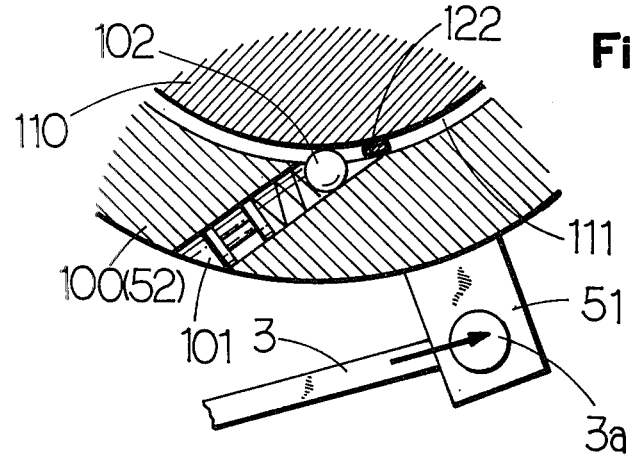
Fig 5e
Fig.6
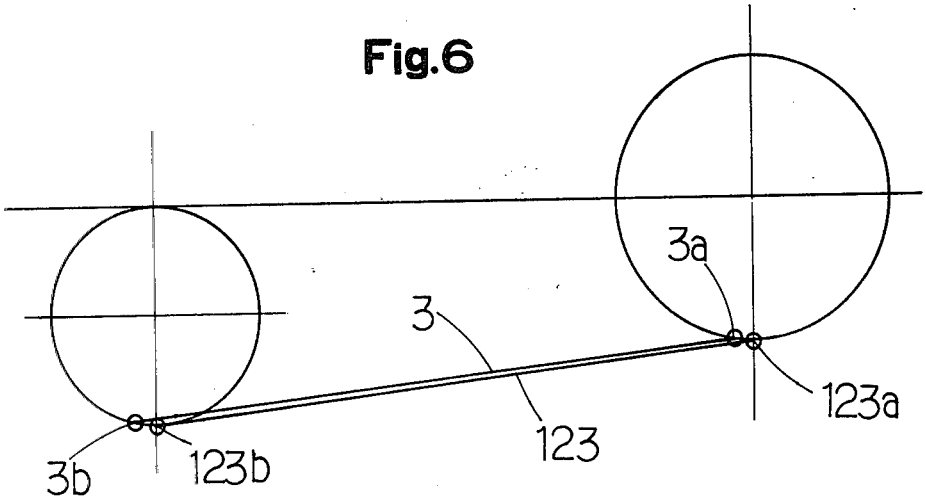

DEVICE FOR HIGH SPEED FEEDING OF A TAPE OR THE LIKE

This invention relates to a device which feeds or advances a tape or the like at a high speed and thereafter quickly interrupts the movement of the tape or the like.

The present invention is applicable to a device which repeats a sequential motion in which a drum picks up and holds a tape or the like around the external surface thereof by vacuum, the drum rotates at a high speed to feed or advance the tape or the like which is stuck around the external surface thereof, and the drum is quickly stopped to allow a cutter to slice the tape or the like, before the second cycle of this sequential motion is resumed.

This equipment is employed, for example, in a machine which repeats a motion to shear a tape on which a number of labels are printed with a uniform interval, to separate each label apart at a high speed.

A mechanism having the function to feed or advance a tape or the like at a high speed and thereafter to quickly interrupt the move of the tape or the like at an exact location was patented by the inventor of the present invention and was published in 1978. (Patent Publication No. Sho 53-9079)

A detailed explanation will be given below for the mechanism of this prior art invention. The mechanism comprises a drum which feeds or advances an article, a main shaft which rotates the drum supported thereon, a high speed crank which drives the shaft through a clutch at a high speed during almost the entire period of a unit cycle period of feeding the article, and a low speed crank which drives the shaft through another clutch at a low speed, after taking over the driving duty from the high speed crank, to feed the article only for a short distance during the last portion of the unit cycle period, whereby the article is fed or advanced at a high speed and thereafter is quickly slowed, before being brought to a stop at an exact location to be sheared by a cutter.

As a result, this mechanism is effective to enable a cutter to shear a tape on which a number of labels are printed at a uniform interval and which is fed at a high speed, at an exact location. The satisfactory function of this mechanism is demonstrated in various cases which are presently under commercial operation.

It is reasonably assumed, however, that a higher speed will definitely be required for this type of mechanism.

Results of experiments carried out with the same drum driven at a higher speed have proved that the above-mentioned mechanism of this prior art invention fails to stop the drum at an exact location, due to the influence of the larger momentum caused by the increased speed of the drum.

Since it was reasonably assumed that the influence of inertia due to the mass of a drum must not be ignored, the mechanism of this prior art invention includes a brake for the purpose of balancing the driving force of the cranks with the braking force thereof, so that the drum slows as soon as the low speed crank takes over the driving duty from the high speed crank. However, the above-mentioned experimental results show that this additional mechanism is not sufficient to allow this prior art mechanism to maintain a proper function, when it is employed at a higher speed.

The dynamic relations of the drum and the cranks are presented below.

(1) The beginning period of the high speed crank's drive

During this period, the shaft and the drum which is integrally formed on the shaft, rotate at a speed determined following the speed of the crank. During this period, the drum is driven by the crank.

(2) The last period of the high speed crank's drive

After passing through the point at which the linear speed of the crank is highest, the driving speed of the crank begins to slow. However, because the drum tends to keep its rotation due to its inertia and also because the clutch is designed to uncouple the connection between the crank and the shaft whenever the drum speed is higher than that of the crank and to transmit motion only during the period in which the crank speed is higher than that of the drum, the drum rotates by itself, outrunning the crank's driving motion.

As a result, even after the driving duty has been taken over by the low speed crank, the drum continues to rotate by itself independently of the driving motion of the low speed crank. As a result, this causes difficulty in stopping the drum at an exact location to allow a cutter to shear an article conveyed by the drum, at the exact location.

The object of the present invention is to solve this problem and to provide a feeder with which it is possible to cause a drum to rotate at a speed determined by the speed of a crank and not to allow the drum to outrun the crank's driving motion even under the conditions in which the drum's inertia can not be ignored.

BRIEF DESCRIPTION OF THE DRAWINGS

FIGS. 5*a*–5*e* are schematic drawings showing the blocked or released position of a brake disk and a steel ball containing cylinder in accordance with this invention; and FIG. 6 is a schematic drawing showing the positional relation of a high speed crank and a release crank.

DETAILED DESCRIPTION OF A PREFERRED EMBODIMENT

THE GENERAL CONSTRUCTION OF THE EMBODIMENT

Figure 1:
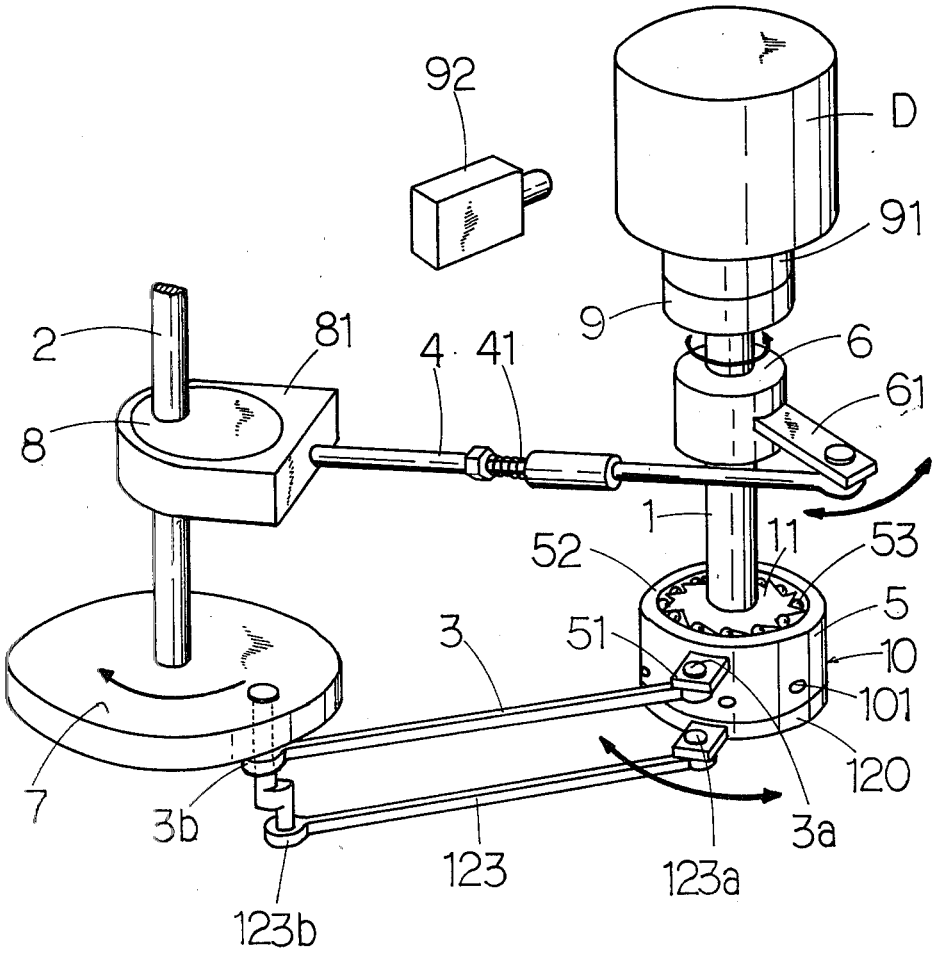
FIG. 1 is a schematic drawing of a feeding machine in accordance with an embodiment of this invention.

This embodiment relates to a mechanism which cyclically rotates and stops a tape feeder drum D which picks up and holds therearound by vacuum, a tape on which a number of labels are printed at a uniform interval, for the purpose to cause the drum D to feed or advance the tape intermittently to a cutter.

A high speed crank 3 and a low speed crank 4 are connected at one end to a shaft 2 driven by a motor or the like and at their other ends to a main shaft 1 which drives the drum D which picks up and holds a tape or the like therearound by vacuum and which is presently used in well-known labeling machines.

The high speed crank 3 is a crank which transmits the driving force of the shaft 2 toward the shaft 1 for driving the drum D for almost the entire portion of a specific unit cycle period of the crank motion.

The low speed crank 4 is a crank which drives the drum D for a limited short period after the high speed crank 3 arrives at the right-hand side dead point of crank motion.

Each of the cranks 3 and 4 is not directly linked to the shaft 1 but is indirectly linked to the shaft 1 through a rotatable linkage arranged for connection of each of the cranks 3 and 4, respectively, to each of arms 51 and 61 projecting respectively from each of clutches 5 and 6. Clutches 5 and 6 transmit motion to the shaft 1 in only one direction.

Figure 2:
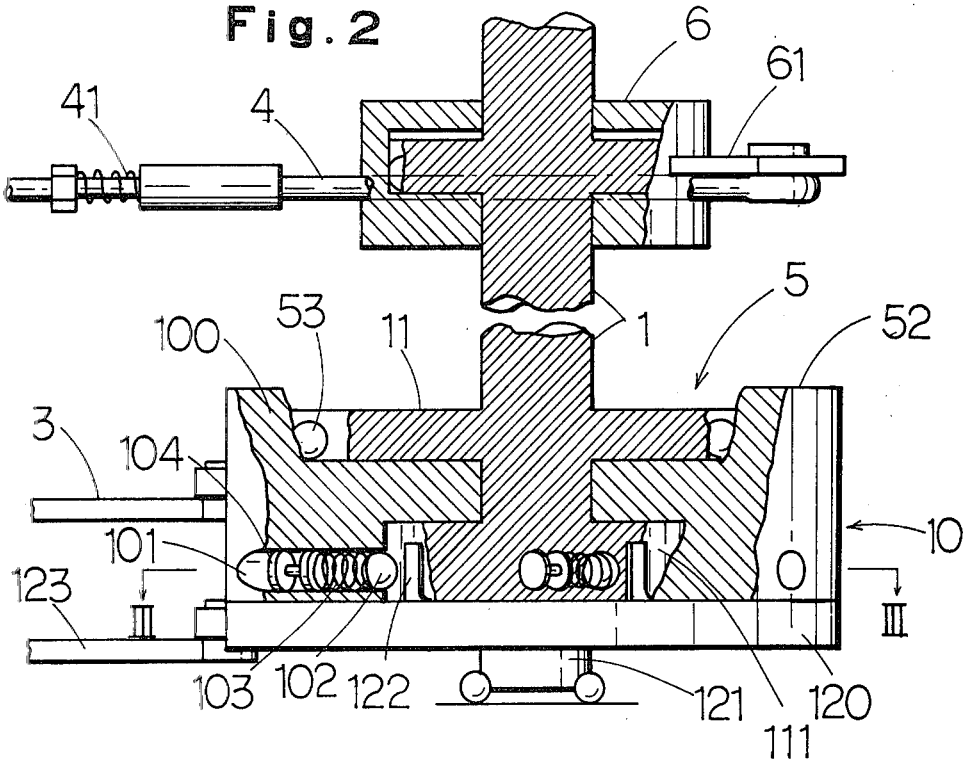
FIG. 2 is a vertical section view of the device in accordance with this invention.

The construction of the clutches 5 and 6 are well-known in the art. As illustrated in FIG. 2, and the upper portion of FIG. 4, one example of the clutches comprises a shaft fitting gear 11 which is integrally formed with the shaft 1, an external cylinder 52 of the clutch 5, and steel balls 53 arranged in open cavity remaining between the teeth of the shaft fitting gear 11 and the internal surface of the external cylinder 52 of the clutch 5.

It is clearly possible for a clutch of this type of construction to convert a reciprocating motion of a crank with a specific length of stroke which is attached to the external cylinder 52 into an intermittent rotation of the shaft 1. However, whenever the shaft 1 is driven by the momentum of the drum D and the rotation speed of the shaft 1 exceeds that of the external cylinder 52, it is quite natural that the shaft 1 outruns or overruns the external cylinder 52. This causes a problem for feeding an article at a high speed.

A rotary disk 7 which can be formed as a disk as shown or more simply as an arm is fitted to the shaft 2 to rotate with the shaft 2. An eccentric wheel 8 is fitted to the shaft 2 to rotate with the shaft 2, and an outer frame 81 is slidably arranged around the external surface of the eccentric wheel 8. One end of the low speed crank 4 is fitted to the outer frame 81.

Accordingly, the rotation of the shaft 2 is converted to an eccentric circular motion to be made by the outer frame 81, before being further converted to a reciprocating motion of the slow speed clutch 6. One end of the high speed crank 3 is rotatably supported on the edge of the rotary disk 7. As a result, the shaft 2 drives the high speed clutch 5 to rotate.

The low speed crank 4 is not a single, solid steel rod but is assembled by connecting two steel rods in series with a spring arranged therebetween. As a result, even if a brake 9 works to brake the shaft 1 before the low speed crank 4 arrives at the right-hand side dead point of crank motion, the remaining motion of the low speed crank 4 is absorbed by the spring 41, and the low speed crank 4 is allowed to finish the motion until it arrives at the right-hand side dead point without providing a destructive amount of force to the low speed clutch 6.

In addition to the electromagnetic brake 9, another clutch 91 can be arranged on the shaft 1 to prevent it from making a reverse rotation. The clutch 91 hampers the drum D from rotating any more, after a photoelectric cell 92 detects a mark presented on each label which is printed with a uniform interval on a tape and causes the shaft 1 to interrupt the rotation for a short while.

MECHANISM FOR PREVENTION OF A DRUM FROM OVERRUNNING

In addition to the high speed clutch 5 which converts the reciprocating motion of the high speed crank 3 to the intermittent rotation of the shaft 1, a mechanism 10 is introduced between the high speed clutch 5 and the shaft 1 to prevent the shaft 1 from overrunning.

This mechanism 10 is a type of inverse-rotation clutch, which does not pass the motion of the high speed clutch 5 to the shaft 1 but instead passes the rotation of the shaft 1 to the high speed clutch 5.

A combination of a steel ball containing cylinder 100 coextensive with the external cylinder 52, a brake disk 110 and a release disk 120 composes a mechanism for prevention of the drum from overrunning.

Figure 3:
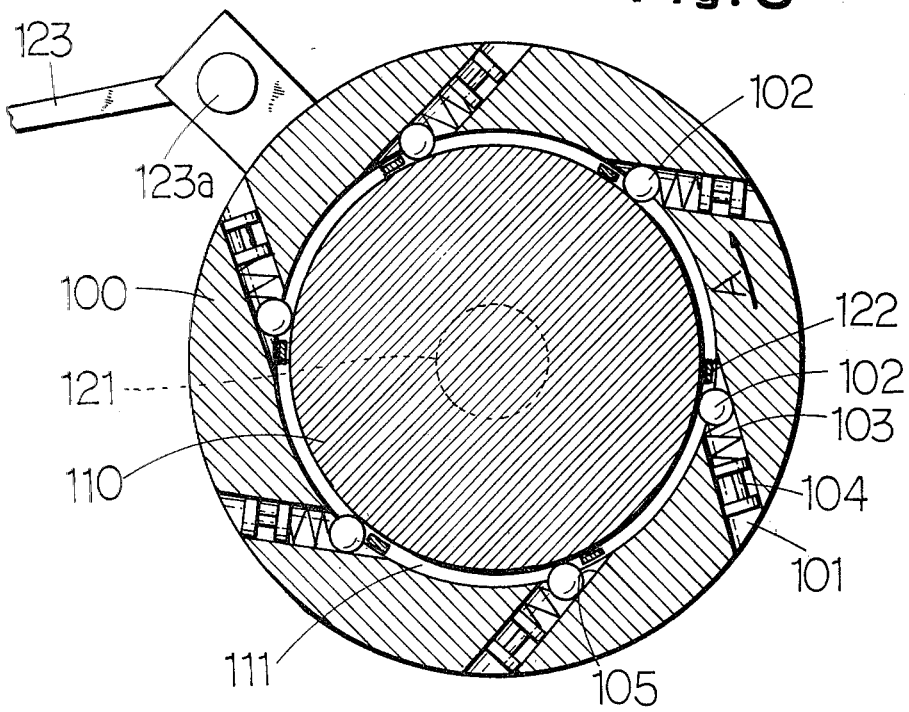
FIG. 3 is a cross-sectional view of FIG. 2 taken along lines III—III.
Figure 4:
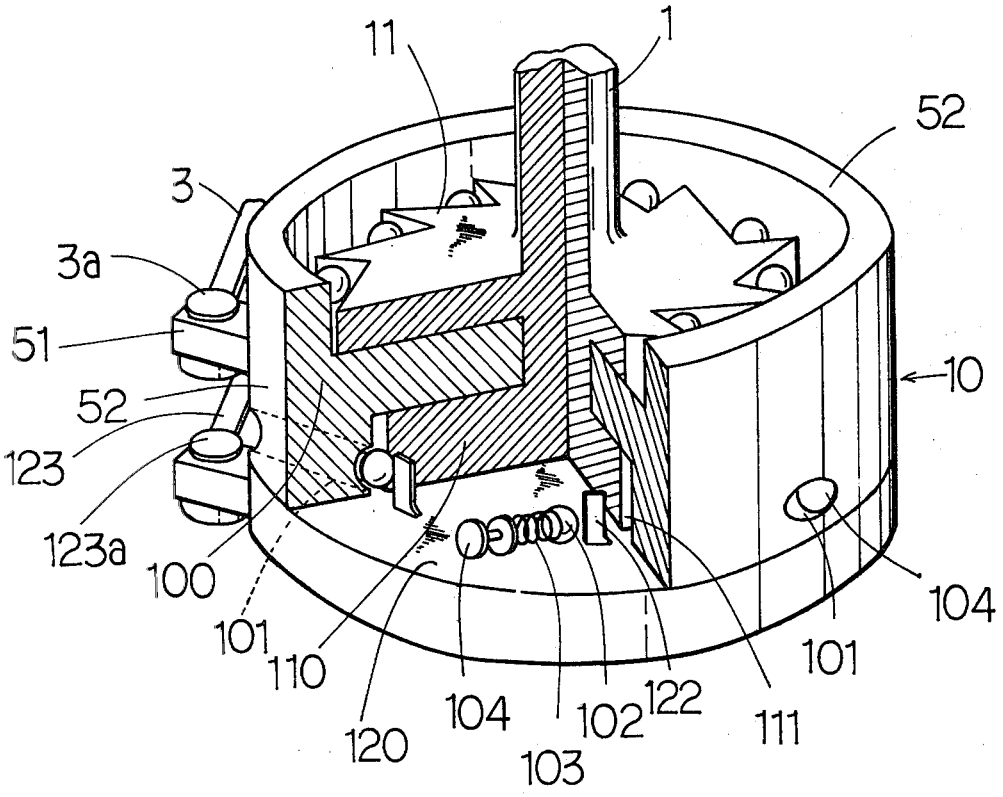
FIG. 4 is a partly cut-away perspective view of the device in accordance with this invention.

Referring to FIGS. 2, 3 and 4, the mechanism is explained below.

(1) Steel ball containing cylinder

The lower portion of the above-mentioned external cylinder 52 forms the steel ball containing cylinder 100 which is integrally formed with the external cylinder 52.

The steel ball containing cylinder 100 has a cylindrical hollow cavity at the center of the cylinder 100 and a plurality of ball containing recesses 101, each of which penetrates the cylinder 100 in a direction which is horizontal and slightly inclined inwardly from the tangent of the cylindrical hollow cavity.

Each of the ball containing recesses 101 contains a steel ball 102, a spring 103 and a plug 104. The steel ball 102 is urged toward the brake disk 110 positioned in the cylindrical hollow cavity, by the force of the spring 103 which is pressed by the plug 104 held by a small nut which is fixed to the steel ball containing cylinder 100.

(2) Brake disk

The brake disk 110 is positioned in the cylindrical hollow cavity in the steel ball containing cylinder 100.

This brake disk 110 is a disk arranged beneath the shaft fitting gear 11 in a direction parallel to the shaft fitting gear 11. These two members are fitted in a position concentric to the shaft 1 and are integrally connected to form a monoblock structure.

As a result, the brake disk 110 rotates together with the drum D and the shaft 1.

A clearance 111 is provided between the external surface of the brake disk 110 and the internal surface of the steel ball containing cylinder 100. The clearance 111 is a uniform radial gap which is smaller than the diameter of each of the steel balls 102. As a result, the steel balls 102 which are always pushed by the force of the springs 103 and are inward projected beyond the internal surface of the steel ball containing cylinder 100, are always urged toward the external surface of the brake disk 110.

Since the steel ball containing recesses 101 are as described above, bored in the direction slightly inclined inwardly from the tangent of the cylindrical hollow cavity toward the cylindrical hollow cavity at the center of the steel ball containing cylinder 100, the steel balls 102 tend to proceed toward the smaller portion of the gap between the one surface 105 of the steel ball containing recess 101 and the external surface of the brake disk 110.

(3) Release disk

The release disk 120 is arranged beneath the brake disk 110. The release disk 120 is not coupled to the shaft 1 or the brake disk 110, so that it is allowed to rotate independently from these members 1 or 110. However, the center of the rotation 121 of the disk 120 is on the extension of the center line of the shaft 1.

Projections 122, equal in number to the number of the steel balls 102, project upwardly on the upper surface of the release disk 120, into the clearance 111 between the external surface of the brake disk 110 and the internal surface of the steel ball containing cylinder 100.

Further, the projections 122 are projected at uniform intervals which are identical to that at which each of the steel balls 102 is arranged under the condition in which the steel balls 102 contact with the external surface of the brake disk 110. Accordingly, the rotation of the release disk 120 around the rotation center 121 causes the projections 122 to push back the steel balls 102 into the ball containing recesses 101 against the thrust of the springs 103.

For the purpose of allowing the shaft 2 to drive this release disk 120, one end of a release crank 123 is linked to the release disk 120 by a pin 123*a* and the other end of the release crank 123 is linked to the rotary disk 7 by a pin 123*b*.

One end of the high speed crank 3 is linked to an arm 51 of the high speed clutch 5 by a pin 3*a* and the other end of the high speed crank 3 is linked to the rotary disk 7 by a pin 3*b*. The high speed crank 3 is arranged parallel with the release crank 123.

The position of the pin 123*a* of the release crank 123, when projected on the horizontal surface perpendicular to the axes of the shafts 1 and 2, deviates from the corresponding position of the pin 3*a* of the high speed crank 3 excepting at the dead points. The position of the pin 123*b* used for the other end of the release crank 123, when projected on the horizontal surface, also deviates from the corresponding position of the pin 3*b*.

Explanation will be given below for the function of the mechanism for prevention of the drum from overrunning.

(1) Release of the brake disk (FIG. 5)

Although the external cylinder 52 of the high speed clutch 5 keeps producing reciprocating motions, the period in which the shaft fitting gear 11, the shaft 1 and the drum D are driven, is limited to the period in which the high speed crank 3 moves from left to right, allowing the external cylinder 52 to rotate without driving anything during the backward stroke period in which the high speed crank 3 returns from the right-hand side dead point toward the left.

During this backward stroke period, the brake disk 110 which is integral with the shaft fitting gear 11 is required not to rotate in the backward direction but to stay unmoved. Therefore, the steel balls 102 must be prevented from being pushed into the clearance 111 during this backward stroke period.

Accordingly, just before the high speed clutch 5 begins a backward stroke, the projections 122 of the release disk 120 push back the steel balls 102 into the ball containing recesses 101 against the thrust of the springs 103, so that the steel ball containing cylinder 100 and the external cylinder 52 which is integral with the steel ball containing cylinder 100 and allowed to make the backward stroke.

(2) During the period in which the drum is ordinarily driven.

Finishing the backward stroke, the high speed clutch 5 resumes the next forward stroke to drive the drum D. Before this forward stroke period begins, the projections 122 move backward to depart from the steel balls 102, resultantly allowing the steel balls 102 to contact the external surface of the brake disk 110 and surfaces 105 of the ball containing recesses 101 by the time when this forward stroke is resumed.

Therefore, even after the steel ball containing cylinder 100 which is integral with the external cylinder 52 resumes a forward stroke to cause the shaft fitting gear 11 to proceed to resultantly cause the brake disk 110 which is integral with the shaft fitting gear 11 to make a forward rotation, there is no restriction for this sequential motion.

However, during this period in which the brake disk 110 is driven by the steel ball containing cylinder 100, neither the steel ball cylinder 100 nor the brake disk 110 performs any function. As a result, they have no functional significance during this period.

(3) During the period in which the drum tends to overrun.

Soon after the low speed clutch 6 has taken over the driving duty from the high speed clutch 4, the drum D tends to overrun due to the influence of its inertia.

At this point of time, the mechanism for prevention of the drum from overrunning begins to work. In other words, as soon as the brake disk 110 begins to rotate at a higher speed than the steel ball containing cylinder 100, the steel balls 102 tend to be pushed into the clearance 111 to restrict the relative motion between the steel ball containing cylinder 100 and the brake disk 110.

Since the brake disk 110 is restricted from rotating at a higher speed than the steel ball containing cylinder 100, the steel ball containing cylinder 100 properly rotates at a speed determined by the high speed crank 3, despite the fact that it is under the influence of the inertia of the drum D which has a big mass.

(4) Release of the brake disk in the next cycle.

Before the clutches 5 and 6 finish their forward stroke and initiate their backward stroke to cause the external cylinder 52 to rotate without driving anything, the projections 122 get into contact with the steel balls 102 again to push them back toward the ball containing recesses 101, resultantly releasing the steel ball containing cylinder 100 from the condition in which the steel ball containing cylinder 100 is blocked by the brake disk 110, by commencement of the backward stroke period.

(5) Synchronized motion of the release disk.

The relative motions of the projections 122 of the release disk 120 and the external cylinder 52 and the steel ball containing cylinder 100 are tabulated below.

Figure 5A:
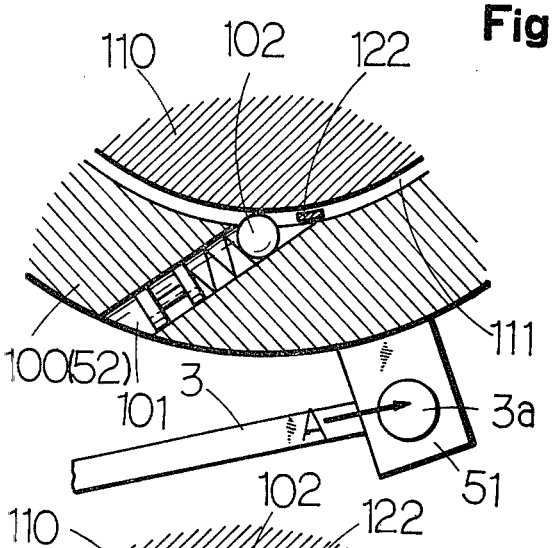
Figure 5B:
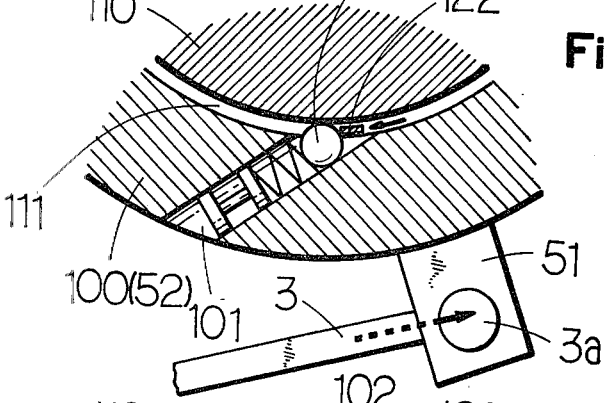
Figure 5C:
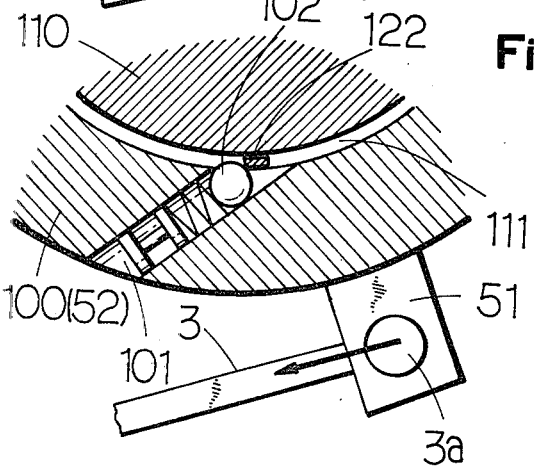

| Position of the projection 122 | Relation between the steel ball containing cylinder 100 and the brake disk 110 | Direction of rotation in relation to the external cylinder 52 |
|---|---|---|
| FIG. 5a | Blocked condition | Forward stroke (A) |
| FIG. 5b | Begin to release | End of the forward stroke |
| FIG. 5c | Release | Backward stroke |
| FIG. 5d | Begin to block | End of the backward stroke |
| FIG. 5e | Blocked condition | Forward stroke |

As is clear from the above table, the projection 122 change the relative position with regard to the steel balls, slightly earlier than the high speed crank 3 arrives at both side dead points of crank motion, so as to enable the projections 122 to properly function. As a result, as shown in FIG. 6, the positional deviation between the pin 3*a* of the high speed crank 3 and the pin 123*a* of the release crank 123 and the positional deviation between the pin 3*b* of the high speed crank 3 and the pin 123*b* of the release crank 123 are the only requirement for the above-mentioned time differential motion.

As explained in the above, this invention is a mechanism which comprises a rotary disk which is produced to be a monoblock with the shaft of a drum, a clutch which allows the shaft to rotate in a single direction, and a means which ties the clutch and unties the clutch from the rotary disk during the backward stroke period.

Consequently, despite the fact that a drum with a big mass tends to keep rotating at a high speed due to the influence of inertia, the drum is not allowed to rotate at a speed higher than that of the clutch. Further, despite the speed transmitted from the clutch rapidly slowing the drum accurately synchronizes, resultantly allowing the drums to stop at a proper position.

As a result, this mechanism is applicable to a machine which feeds a tape on which a number of labels are printed at a uniform interval for the purpose of feeding the tape at a high speed and thereafter to quickly stop the tape to allow a cutter to shear the tape at a proper position.

What is claimed is:

1. In a device for high speed feeding and stopping of an article which comprises a shaft, a drum for carrying said article fitted to said shaft, a first clutch having an external cylinder and being mounted on said shaft, a high speed crank for driving said drum at a high speed linked to said shaft with said first clutch, a second clutch on said shaft, and a low speed crank for driving said drum at a low-speed linked to said shaft with said second clutch, the improvement which comprises a brake disk integral with said shaft, a steel ball containing cylinder integral with the external cylinder of said first clutch for high speed driving, a plurality of steel balls arranged between said brake disk and said steel ball containing cylinder, and a plurality of projections positioned closely to said steel balls interposable between said brake disk and said steel balls, whereby said steel balls are detached from said brake disk during the backward stroke period of the external cylinder of said first clutch for high speed driving.

2. The device for high speed feeding and stopping of an article defined in claim 1, further comprising a release disk arranged adjacent said steel ball containing cylinder and concentric to said shaft, said release disk carrying said projections on said surface, and a release crank for driving said release disk at a high speed equal to the speed of the high speed crank at a position slighly ahead of said high speed crank whereby a slight time difference results between the reciprocating motion of said release disk and the reciprocating motion of the external cylinder of said first clutch for high speed driving.

3. The device for high speed feeding and stopping of an article defined in claim 1, wherein plural steel ball containing recesses are excavated in said steel ball containing cylinder in the direction which is inclined from the direction of the radius of said steel ball containing cylinder and each of said steel ball containing recesses contains one of said steel balls and a spring urging said steel ball toward said brake disk.

* * * * *